US005735682A

United States Patent [19]

Toth

[11] Patent Number: 5,735,682

[45] Date of Patent: Apr. 7, 1998

[54] FLUIDIZED BED COMBUSTION SYSTEM HAVING AN IMPROVED LOOP SEAL VALVE

[75] Inventor: Stephen Joseph Toth, Clinton Township, N.J.

[73] Assignee: Foster Wheeler Energy Corporation, Clinton, N.J.

[21] Appl. No.: 782,862

[22] Filed: Jan. 13, 1997

Related U.S. Application Data

[63] Continuation of Ser. No. 288,865, Aug. 11, 1994, abandoned.

[51] Int. Cl.[6] ..... F23J 15/02

[52] U.S. Cl. ..... 431/170; 110/245; 110/216; 110/345

[58] Field of Search ..... 431/7, 190; 122/4 D; 110/216, 345, 245

[56] References Cited

U.S. PATENT DOCUMENTS

| | | | |
|---|---|---|---|
| 1,202,088 | 10/1916 | Murry . | |
| 2,881,133 | 4/1959 | Whiteley et al. . | |
| 3,537,755 | 11/1970 | Schmidt . | |
| 3,575,471 | 4/1971 | Meyer . | |
| 3,874,739 | 4/1975 | Mitchell . | |
| 4,116,168 | 9/1978 | Gorzegno et al. . | |
| 4,442,795 | 4/1984 | Strohmeyer, Jr. . | |
| 4,442,796 | 4/1984 | Strohmeyer, Jr. . | |
| 4,473,033 | 9/1984 | Strohmeyer, Jr. | 122/4 D |
| 4,579,070 | 4/1986 | Lin et al. | 122/4 D |
| 4,686,939 | 8/1987 | Stromberg | 110/245 X |
| 4,704,084 | 11/1987 | Liu et al. | 122/4 D |
| 4,709,662 | 12/1987 | Rawdon . | |
| 4,733,621 | 3/1988 | Kostamo et al. | 122/4 D |
| 4,781,574 | 11/1988 | Taylor | 431/170 |
| 4,793,292 | 12/1988 | Engstrom et al. . | |
| 4,817,540 | 4/1989 | Razbin et al. . | |
| 4,827,723 | 5/1989 | Engstrom et al. . | |
| 4,869,207 | 9/1989 | Engstrom et al. . | |
| 4,896,717 | 1/1990 | Campbell, Jr. et al. . | |
| 4,917,025 | 4/1990 | Buchmuller et al. . | |
| 4,947,804 | 8/1990 | Abdulally . | |
| 5,040,492 | 8/1991 | Dietz . | |
| 5,054,436 | 10/1991 | Dietz . | |
| 5,069,170 | 12/1991 | Gorzegno et al. . | |
| 5,069,171 | 12/1991 | Hansen et al. . | |
| 5,078,100 | 1/1992 | Huschauer et al. . | |
| 5,140,950 | 8/1992 | Abdulally . | |
| 5,141,708 | 8/1992 | Campbell, Jr. et al. . | |
| 5,218,932 | 6/1993 | Abdulally . | |

*Primary Examiner*—Carl D. Price
*Attorney, Agent, or Firm*—Haynes and Boone, L.L.P.

[57] ABSTRACT

A fluidized bed combustion system in which a separator receives a mixture of flue gases and entrained particulate material from a fluidized bed in a furnace. A loop seal valve, in the form of three ducts, connects an outlet of the separator to the furnace for recycling the separated particulate material back to the furnace. One of the ducts extends vertically from the separation and another duct extends horizontally from the latter duct and connects this latter duct to an angled duct which registers with an opening in the furnace wall. The last duct is angled downwardly to provide an increased throughput when compared to standard loop seal devices.

8 Claims, 1 Drawing Sheet

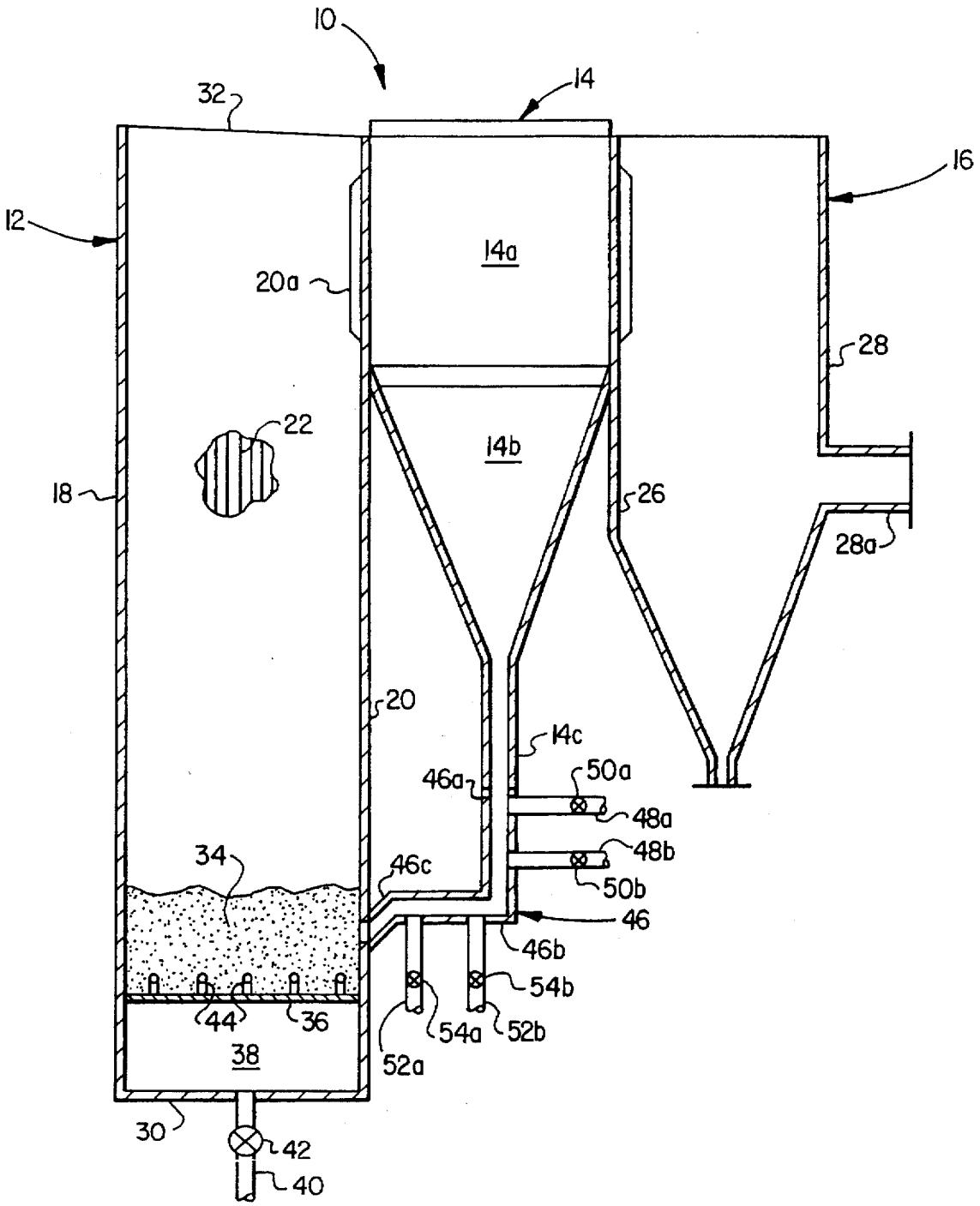
10
14
32
16
12
14a
20a
28
22
14b
18
26
28a
20
14c
46a
50a
48a
48b
34
46c
50b
46
46b
54b
44
36
54a
52b
38
52a
30
42
40

FLUIDIZED BED COMBUSTION SYSTEM HAVING AN IMPROVED LOOP SEAL VALVE

This is a continuation of application(s) Ser. No. 08/288,865 filed on Aug. 11, 1994, abandoned.

This invention relates to a fluidized bed combustion system and method, and, more particularly, to such a system and method in which an improved pressure loop seal valve is provided between the furnace section of the fluidized bed and the separating section.

Fluidized bed combustion systems are well known and include a furnace section in which air is passed through a bed of particulate material, including a fossil fuel, such as coal, and a sorbent for the oxides of sulfur generated as a result of combustion of the coal, to fluidize the bed and to promote the combustion of the fuel at a relatively low temperature. These types of combustion systems are often used in steam generators in which water is passed in a heat exchange relationship to the fluidized bed to generate steam and permit high combustion efficiency and fuel flexibility, high sulfur adsorption and low nitrogen oxides emissions.

The most typical fluidized bed utilized in the furnace of these type systems is commonly referred to as a "bubbling" fluidized bed in which the bed of particulate material has a relatively high density and a well-defined, or discrete, upper surface. Other types of systems utilize a "circulating" fluidized bed in which the fluidized bed density is below that of a typical bubbling fluidized bed, the fluidizing air velocity is equal to or greater than that of a bubbling bed, and the flue gases passing through the bed entrain a substantial amount of the fine particulate solids to the extent that they are substantially saturated therewith.

Circulating fluidized beds are characterized by relatively high internal and external solids recycling which makes them insensitive to fuel heat release patterns, thus minimizing temperature variations and, therefore, stabilizing the sulfur emissions at a low level. The external solids recycling is achieved by disposing a cyclone separator at the furnace outlet to receive the flue gases, and the solids entrained thereby, from the fluidized bed. The solids are separated from the flue gases in the separator and the flue gases are passed to a heat recovery area while the solids are recycled back to the furnace. This recycling improves the efficiency of the separator, and the resulting increase in the efficient use of sulfur adsorbent and fuel residence time reduces the adsorbent and fuel consumption.

In the circulating fluidized bed arrangements, it is important that a pressure seal be provided between the separator and the furnace to prevent backflow of gases, with entrained solids, directly from the furnace to the outlet of the separator. Previous arrangements have utilized various forms of loop seal valves, such as a "J-valve" which has a vertical portion extending from the dipleg of the separator and a U-shaped portion extending from the vertical portion to create the pressure seal. U.S. Pat. No. 4,947,804 and U.S. Pat. No. 5,040,492, both assigned to the assignee of the present invention, disclose the use of a J-valve used in this type of environment. J-valves of this type are designed so that the height of the solids in the dipleg portion of the valve directly corresponds to the sum of the pressure drops across the furnace and the separator. However, in order to operate satisfactorily, these J-valves require a relatively high fluidizing air pressure necessitating additional fans which are expensive.

In order to overcome these deficiencies, another type of loop seal valve has been devised, in the form of an "L-valve" which includes a vertical portion extending from the dipleg of the separator and a horizontal leg connecting the outlet of the vertical leg to the furnace. U.S. Pat. No. 4,709,662 discloses an L-valve connecting the outlet of an external heat exchanger to the inlet of a furnace. In the L-valve, solid material accumulates in the vertical portion to form a head of material providing a pressure seal. Although the L-valve enjoys the advantage of being drainable, i.e. solids can be removed from the valve during shutdown or the like, it must be relatively large in size for a given throughput.

SUMMARY OF THE INVENTION

It is therefore an object of the present invention to provide a fluidized bed combustion system and method which has an improved loop seal valve between the furnace and the separator to provide a pressure seal.

It is a still further object of the present invention to provide a system and method of the above type in which the loop seal valve can be of a relatively small size for a given throughput.

It is a still further object of the present invention to provide a system and method of the above type in which the loop seal valve has a sloped spillway between a horizontal portion of the valve and the furnace return point.

Toward the fulfillment of these and other objects, a fluidized bed combustion system is provided in which a separator receives a mixture of flue gases and entrained particulate material from the fluidized bed in the furnace and separates the particular material from the flue gases. A loop seal valve connects the outlet of the separator to the furnace for passing the separated material from the separator to the furnace. The valve has a vertical portion connected to the separator outlet, a horizontal portion connected to the vertical portion, and a sloped spillway connected between horizontal portion and the furnace return point, to enable the valve to be reduced in size for a given throughput.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawing which is a schematic representation depicting the system and the valve of the present invention.

DESCRIPTION OF THE PREFERRED EMBODIMENT

The fluidized bed reactor of the present invention is shown in general by the reference numeral 10 in the drawing. The reactor 10 includes a furnace section 12, a separating section 14 and a heat recovery section 16, all shown in section with their internal components removed for the convenience of presentation.

The furnace section 12 is defined by a front wall 18, a rear wall 20 and two sidewalls one of which is shown by the reference numeral 22. Two walls 26 and 28 are provided in a spaced parallel relation to the wall 20 with the separating section 14 being defined in part by the walls 20 and 26, and the heat recovery section 16 being defined in part by the walls 26 and 28. A floor 30 is provided in the furnace section 12 and a roof 32 extends over the furnace section 12, the separating section 14 and the heat recovery section 16. Although not shown in the drawings, it is understood that the separating section 14 and the heat recovery section 16 are provided with sidewalls, which can be extensions of the sidewalls 22 of the furnace section 12.

An opening 20*a* is provided in the upper portion of the wall 20 for permitting combustion flue gases produced in the furnace section 12 to pass from the furnace section into the separating section 14. It is understood that proper ducting (not shown) is provided to permit the gases to pass from the separating section 14 to the heat recovery section 16, as will be explained.

It is understood that if the reactor 10 is used for the purpose of steam generation, the walls 18, 20, 22, 26 and 28 would be formed by a plurality of heat exchange tubes formed in a parallel, gas tight manner to carry the fluid to be heated, such as water. These tubes are shown schematically in the drawing with reference to the sidewall 22. It is also understood that a plurality of headers (not shown) would be disposed at both ends of each of the walls 18, 20, 22, 26 and 28 which, along with additional tubes and associated flow circuitry, would function to route the water through the interior of the reactor and to and from a steam drum (not shown) in a conventional manner. These components are omitted in the drawings for the convenience of presentation.

A bed of particulate material, shown in general by the reference numeral 34, is disposed within the furnace section 12 and rests on a perforated plate 36 extending horizontally in the lower portion of the furnace section. The bed 34 can consist of discrete particles of fuel material, such as bituminous coal, which are introduced into the furnace section 12 by a feeder or the like in any known manner. It is understood that a sulfur adsorbing material, such as limestone, can also be introduced into the furnace section 12 in a similar manner which material adsorbs the sulfur generated by the burning coal.

It is also understood that a bed light-off burner (not shown) is mounted through the wall 18 immediately above the plate 36 for initially lighting off a portion of the bed 34 during start-up.

A plenum 38 is defined between the plate 36 and the floor 30 and receives pressurized air from an external source via air conduit 40 under control of a damper 42. A plurality of nozzles 44 extend through perforations provided in the plate 36 and are adopted to discharge air from the plenum 38 into the bed 34 supported on the plate 36. The air passing through the bed 34 fluidize the bed to promote combustion of the fuel and combines with the products of combustion to form flue gases which rise by convection in the furnace section 12. The flue gases entrain a portion of the relatively fine particulate material in the furnace section 12 before passing, via the opening 20*a*, into the separating section 14.

The separating section 14 includes a cyclone separator 14*a* which functions in a conventional manner to separate the entrained particulate material from the flue gases. The separated flue gases pass to the heat recovery section 16 in the manner described above. It is understood that one or more heat exchange units, such as a superheater, reheater or the like can be provided in the heat recovery section 16 for removing the heat from the separated flue gases as they pass downwardly in the section 16 before exiting through an outlet 28*a* extending through the wall 28.

The separated particulate material passes from the separator 14*a* into a hopper 14*b* of the separating section 14. A dipleg 14*c* extends downwardly from the hopper 14*b* of the separating section 14 to a loop seal valve, shown in general by the reference numeral 46, for preventing the backflow of particulate material and/or gases directly from the furnace section 12 to the separating section 14. The valve 46 includes a vertical portion 46*a* that is connected, in registry, with the lower end portion of the dipleg 14*c*. A horizontal portion 46*b* of the valve 46 connects the vertical portion 46*a* to an angled spillway portion 46*c* which extends to an opening 20*b* provided in the rear wall 20 of the furnace 12. It is noted from the drawing that the horizontal valve portion 46*b* is located at an elevation above that of the opening 20*b* in the furnace wall 20, and that the angled valve portion 46*c* extends downwardly at an acute angle to the horizontal valve portion 46*b* to provide advantages that will be described. Preferably the valve portions 46*a*, 46*b* and 46*c* are circular in cross-section with the exceptions of portions 46*b* and 46*c* each having a rectangular cross-section for at least its bottom half over which the separated particulate material flows, as will be described.

A pair of air inlet conduits 48*a* and 48*b* register with the vertical valve portion 46*a* for receiving air from an external source and introducing the air into the latter portion under the control of dampers 50*a* and 50*b* respectively mounted in the conduits. Similarly, a pair of air inlet conduits 52*a* and 52*b* register with the horizontal valve portion 46*b* for also receiving air from an external source and introducing the air into the latter portion under the control of two dampers 54*a* and 54*b* disposed in the conduits 52*a* and 52*b*, respectively. The air so introduced into the valve portions 46*a* and 46*b* aerates the separated particulate material in the valve 46 and promotes its flow through the valve. It is understood that the use of two air inlet conduits associated with each valve portion 46*a* and 46*b* is for purposes of example only, and that the number of air conduits employed can vary within the scope of the invention.

In operation, particulate fuel material and adsorbent are introduced into the furnace section 12 and accumulate on the plate 36. Air from an external source passes into the plenum 38 via the air conduit 40, through the plate 36, and the nozzles 44 and into the particulate material on the plate to fluidized the bed 34.

The light-off burner (not shown) or the like is fired to ignite the particulate fuel material in the bed 34. When the temperature of the material in the bed 34 reaches a predetermined level, additional particulate material is continuously discharged onto the upper portion of the bed. The air promotes the combustion of the fuel and the velocity of the air is controlled by the damper 42 to exceed the minimum fluidizing velocity of the bed 34 to form either a bubbling, circulating or hybrid fluidized bed.

As the fuel burns and the adsorbent particles are reacted, the continual influx of air through the nozzles 44 creates a homogenous fluidized bed of particulate material including unburned fuel, partially-burned fuel, and completely-burned fuel along with unreacted adsorbent, partially-reacted adsorbent and completely-reacted adsorbent.

A mixture of air and the gaseous products of combustion pass upwardly through the bed 34 and entrain, or elutriate, the relatively fine particulate material in the bed. The resulting mixture of flue gases passes upwardly in the furnace section 12 by convection before it exits the furnace section through the opening 20*a* and passes into the separating section 14*a* which functions in a conventional manner to separate the entrained particulate material from the flue gases. The separated particulate material, or separated solids, then fall by gravity into the hopper 14*b* from which they pass through the dipleg 14*c* and into the vertical valve portion 46*a* of the seal valve 46. The solids then flow through the vertical valve portion 46*a* and the horizontal valve portion 46*b* with the flow being promoted by the introduction of air into the valve portion 46*a* by the conduits 48*a* and 48*b* under control of the dampers 50*a* and 50*b*, respectively; and into the valve portion 46*b* by the conduits 52*a* and 52*b* under control of the dampers 54*a* and 54*b*, respectively. The flow continues through the valve 46 to the angled valve portion 46*c* which angles downwardly to enable the solids to flow, with the assistance of gravity, through the opening 20*b* and back into the enclosure 12. The rate of this recycling is varied in any conventional manner, such as by varying the air velocity through the conduits 48*a*, 48*b* 52*a* and 52*b*, so that the height of the separated solids in the vertical valve portion 46*a*builds up to a level sufficient to act as a pressure seal between the openings 20*b* in the wall 20 of the enclosure 12 and the hopper 14*b*.

The relatively clean flue gases pass from the separating section 14*a* pass into the heat recovery section 16 and through the latter section before exiting the reactor via the outlet 28*a*.

The loop seal valve 46 has several advantages. For example, it creates a non-mechanical pressure seal valve which prevents the backflow of particulate material from the furnace to the separator. Also, the downwardly-angled portion 46*c* permits a gravity assist, and therefore an increased, flow of particulate material from the dipleg to the enclosure 12, permitting the size of the valve to be smaller when compared to J-valves and L-valves operating with the same throughput. Also, the valve 46 is not sensitive to back pressure surges from the furnace.

Modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A pressure seal valve for use in a fluidized bed combustion system including a furnace containing a fluidized bed and a separator for receiving a mixture of flue gases and entrained particulate material from the fluidized bed and separating the particulate material from the flue gases, the pressure seal valve comprising:

a first duct connected to the separator outlet for receiving the separated material and extending vertically to promote the flow of the separator through the duct by gravity;

a second duct connected to the first duct and extending horizontally for receiving the separated material from the first duct;

a third duct extending at an angle to the second duct and connecting the second duct to the furnace for passing the separated material back to the furnace;

a first conduit connected to the first duct for introducing air into the first duct for promoting the flow of the separated material from the separator, through the first duct, and to the furnace;

a second conduit connected to the second duct for introducing air into the second duct for promoting the flow of the separated material from the separator, through the second duct, and to the furnace; and a damper associated with each of the conduits for regulating the introduction of the air, and therefore the flow of the material to the ducts and the height of the material in the first duct, to establish a pressure seal for preventing the backflow of the separated material from the furnace to the separator.

2. The pressure seal valve of claim 1 where the first conduit extends perpendicular to the first duct and the second conduit extends perpendicular to the second duct.

3. The pressure seal valve of claim 1 further comprising an additional conduit connected to the first duct, and an additional conduit connected to the second duct, for introducing additional air into the ducts, and a damper associated with each additional conduit for regulating the introduction of air into the additional conduits.

4. The pressure seal valve of claim 1 wherein the third duct extends downwardly from the second duct.

5. A fluidized bed combustion system comprising:

a furnace for receiving fluidized bed of combustible particulate material;

a separator for receiving a mixture of flue gases and entrained particulate material from the fluidized bed in the furnace and separating the particulate material from the flue gases, the separator comprising an outlet for discharging the separated material; and a seal valve connecting the separator outlet to the furnace for returning the separated material to the furnace, the seal valve comprising:

a first duct connected to the separator outlet for receiving the separated material and extending vertically to promote the flow of the separator through the duct by gravity;

a second duct connected to the first duct and extending horizontally for receiving the separated material from the first duct;

a third duct extending at an angle to the second duct and connecting the second duct to the furnace for passing the separated material back to the furnace;

a first conduit connected to the first duct for introducing air into the first duct for promoting the flow of the separated material from the separator, through the first duct, and to the furnace;

a second conduit connected to the second duct for introducing air into the second duct for promoting the flow of the separated material from the separator, through the second duct, and to the furnace; and a damper associated with each of the conduits for regulating the introduction of the air, and therefore the flow of the material to the ducts and the height of the material in the first duct, to establish a pressure seal for preventing the backflow of the separated material from the furnace to the separator.

6. The system of claim 5 where the first conduit extends perpendicular to the first duct and the second conduit extends perpendicular to the second duct.

7. The system of claim 5 further comprising an additional conduit connected to the first duct, and an additional conduit connected the second duct, for introducing additional air into the ducts, and a damper associated with each additional conduit for regulating the introduction of air into the additional conduits.

8. The system of claim 5 wherein the third duct extends downwardly from the second duct.

* * * * *